US006637398B2

(12) United States Patent
Suzuki et al.

(10) Patent No.: US 6,637,398 B2
(45) Date of Patent: Oct. 28, 2003

(54) ENGINE FOR MOTORCYCLES

(75) Inventors: Masatoshi Suzuki, Saitama (JP); Ryo Kubota, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/060,250

(22) Filed: Feb. 1, 2002

(65) Prior Publication Data

US 2002/0104504 A1 Aug. 8, 2002

(30) Foreign Application Priority Data

Feb. 2, 2001 (JP) ..... 2001-026372

(51) Int. Cl.[7] ..... F02F 7/00
(52) U.S. Cl. ..... 123/195 R
(58) Field of Search ..... 123/195 R, 572, 123/573, 195 C, 192.2, 48 B, 197.1, 197.4, 54.1, 54.4, 53.1, 48 R, 78 R, 51 BB, 53.5

(56) References Cited

U.S. PATENT DOCUMENTS 4,517,933 A 5/1985 Yasutake
4,714,061 A 12/1987 Nakayama et al.
4,945,866 A * 8/1990 Chabot, Jr. ..... 123/53.1
6,058,901 A * 5/2000 Lee ..... 123/197.1
6,343,584 B1 * 2/2002 Kudou et al. ..... 123/196 R

FOREIGN PATENT DOCUMENTS

JP 358065936 A * 4/1983 ..... 123/195 R
JP 11-29085 2/1999

OTHER PUBLICATIONS

Patent Abstracts of Japan, vol. 014, No. 395, Aug. 27, 1990, for JP 02 149731A (Jun. 8, 1990).

* cited by examiner

*Primary Examiner*—Henry C. Yuen
*Assistant Examiner*—Hyder Ali
(74) *Attorney, Agent, or Firm*—Birch, Stewart, Kolasch & Birch, LLP

(57) ABSTRACT

In an engine for a motor vehicle, an upward offset of a transmission input shaft is sufficiently increased without being obstructed by a cylinder block. This shortens the overall length of the engine in the longitudinal direction of the motorcycle. The engine for a motor vehicle has a cylinder block extending upwardly and forwardly of the motor vehicle from an upper portion of the front end of a crankcase. A transmission input shaft is offset upwardly with respect to a plane, which includes the axes of a crankshaft and a transmission output shaft. The cylinder block is disposed to have an axis passing forwardly of the axis of the crankshaft. With this construction, it is possible to sufficiently increase an upward offset of the transmission input shaft without being obstructed by the cylinder block.

20 Claims, 4 Drawing Sheets

ENGINE FOR MOTORCYCLES

CROSS-REFERENCE TO RELATED APPLICATIONS

This nonprovisional application claims priority under 35 U.S.C. §119(a) on Patent Application No. 2001-026372 filed in Japan On Feb. 2, 2001, the entirety of which is herein incorporated by reference.

BACKGROUND OF THE INVENTION

1. Field of the Invention

The present invention relates to an engine for a motorcycle. In particular, the present invention relates to an engine for a motorcycle having a crankcase, a cylinder block, and a cylinder head. The cylinder block extends upwardly and forwardly of the motor vehicle from an upper portion of the front end of the crankcase. The cylinder head is joined to the upper end of the cylinder block. The crankcase houses and supports a crankshaft, a transmission input shaft, and a transmission output shaft, which are arranged to have their axes oriented transversely of the motor vehicle. The transmission input shaft is offset upwardly with respect to a plane, which includes the axes of the crankshaft and the transmission output shaft.

2. Description of Background Art

Conventional engines for motorcycles generally have a cylinder block arranged to have an axis extending across the axis of the crankshaft (see, for example, Japanese Patent Laid-open No. Hei 11-29085).

In such engines for motorcycles, offsetting a transmission input shaft upwardly with respect to a plane which includes the axes of a crankshaft and a transmission output shaft is effective to reduce the interaxial distance between the crankshaft and the transmission output shaft to shorten the overall length of the engine in the longitudinal direction of the motorcycle for making the engine compact. However, the conventional engines fail to provide a sufficient upward offset of the transmission input shaft because of the cylinder block, which is positioned in the way. One solution would be to reduce the angle through which the cylinder block rises from the horizontal plane in order to provide a sufficient upward offset of the transmission input shaft. However, the front end of the cylinder head would be shifted forwardly. Accordingly, there would be an increase in the overall length of the engine in the longitudinal direction of the motorcycle. This increase would cancel out the reduction in the overall length of the engine in the longitudinal direction of the motorcycle, which is provided by the increased upward offset of the transmission input shaft.

SUMMARY OF THE INVENTION

The present invention has been made in view of the above drawbacks. It is an object of the present invention to provide an engine for motorcycles which has a transmission input shaft of which the upward offset is sufficiently increased without being obstructed by the cylinder block to effectively reduce the overall length of the engine in the longitudinal direction of the motorcycle.

To achieve the above object, there is provided in accordance with a first feature of the present invention an engine for a motor vehicle having a crankcase, a cylinder block extending upwardly and forwardly of the motor vehicle from an upper portion of the front end of the crankcase, and a cylinder head joined to the upper end of the cylinder block. The crankcase houses and supports a crankshaft, a transmission input shaft, and a transmission output shaft, arranged to have their axes oriented transversely of the motor vehicle. The transmission input shaft is offset upwardly with respect to a plane, which includes the axes of the crankshaft and the transmission output shaft. The cylinder block is disposed to have an axis passing forwardly of the axis of the crankshaft.

According to the above first feature, the cylinder block is disposed to have an axis passing forwardly of the axis of the crankshaft. Accordingly, if the angle through which the axis of the cylinder block rises from the horizontal plane is increased, then a free upper area of the crankcase, which is not obstructed by the cylinder block, is widened without changing the position of the front end of the engine. Therefore, the upward offset of the input shaft with respect to the horizontal plane can be sufficiently increased without being obstructed by the cylinder block. Therefore, the interaxial distance between the crankshaft and the output shaft is effectively shortened. As a result, the size of the crankcase in the longitudinal direction of the motorcycle is made compact, thus reducing the overall length of the engine in the longitudinal direction of the motorcycle for thereby effectively making the engine compact.

The offset of the axis of the cylinder block with respect to the axis of the crankshaft causes a reduction in the angle of inclination of the connecting rod under a maximum pressure in the expansion stroke of the engine. As a result, a side thrust which the piston receives from the inner surface of the cylinder bore is reduced, reducing the frictional resistance to the sliding motion of the piston, which contributes to lower fuel consumption.

According to a second feature of the present invention, in addition to the first feature, the cylinder block is disposed substantially parallel to a downward portion of a down tube of a vehicle frame.

According to the second feature, the dead space between the down tube and the cylinder head is minimized to reduce the wheelbase of the motorcycle.

According to a third feature of the present invention, in addition to the first and second features, a breather chamber communicates with the interior of the crankcase and is mounted on a portion of the crankcase near a rear surface of the cylinder block.

According to the third feature, the dead space present between the cylinder block and the input shaft in the crankcase is effectively utilized to form the breather chamber, further making the engine compact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
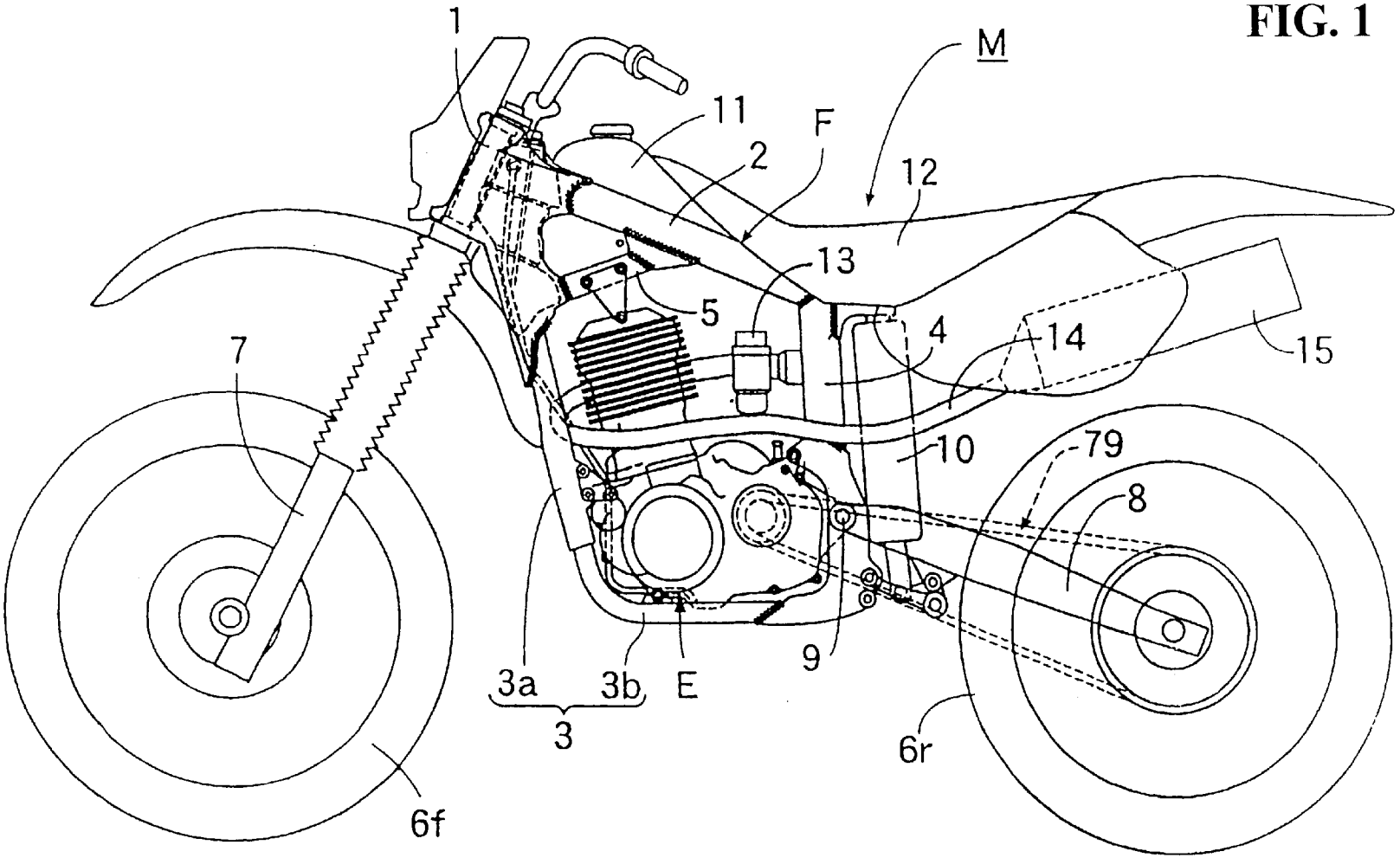
FIG. 1 is a side elevational view of a motorcycle which incorporates an engine according to a first embodiment of the present invention.
Figure 2:
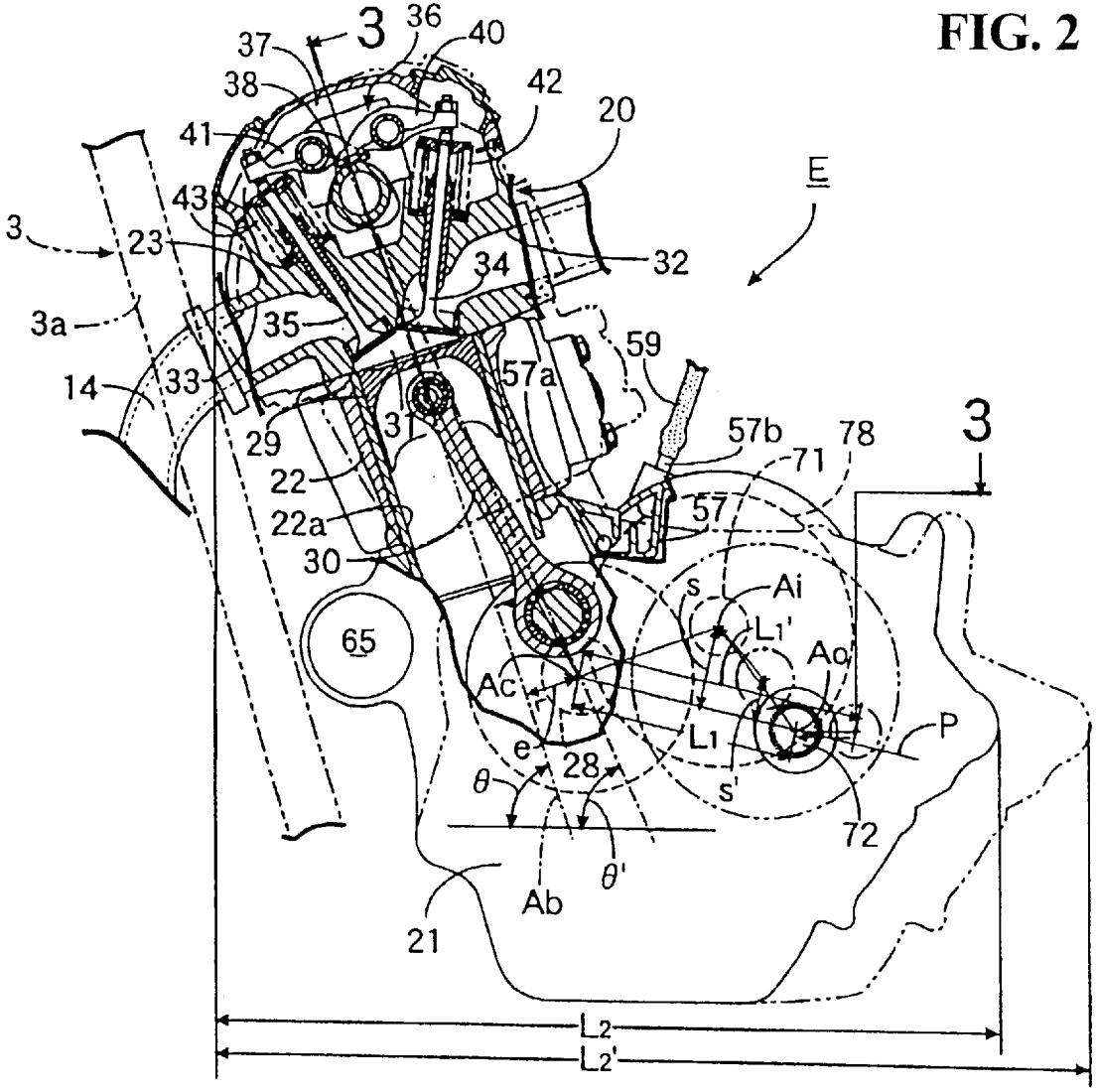
FIG. 2 is a side elevational view, partly in vertical cross section, of the engine (a cross-sectional view taken along line 2—2 of FIG. 3)
Figure 3:
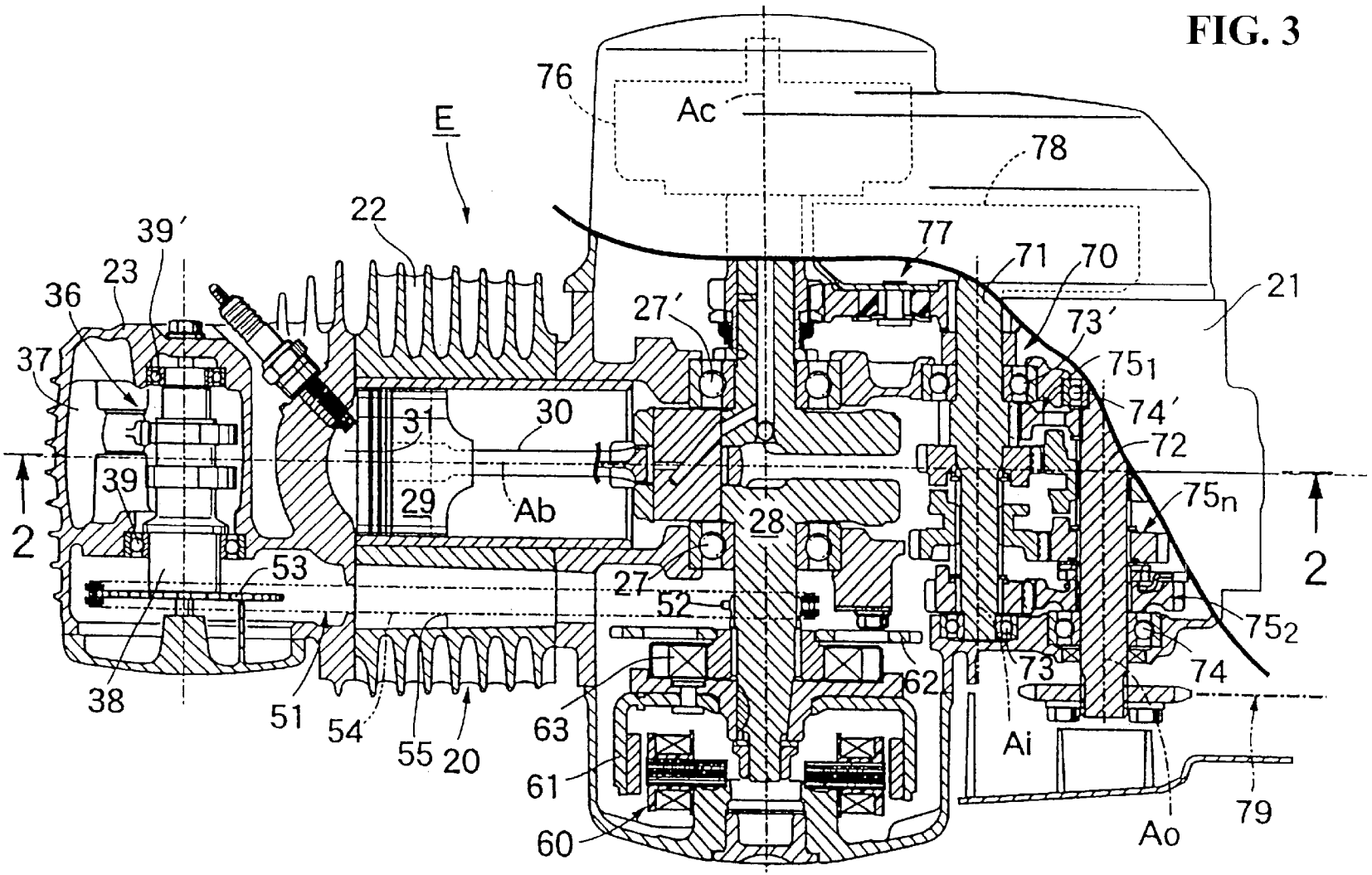
FIG. 3 is a cross-sectional view taken along line 3—3 of FIG. 2.
Figure 4:
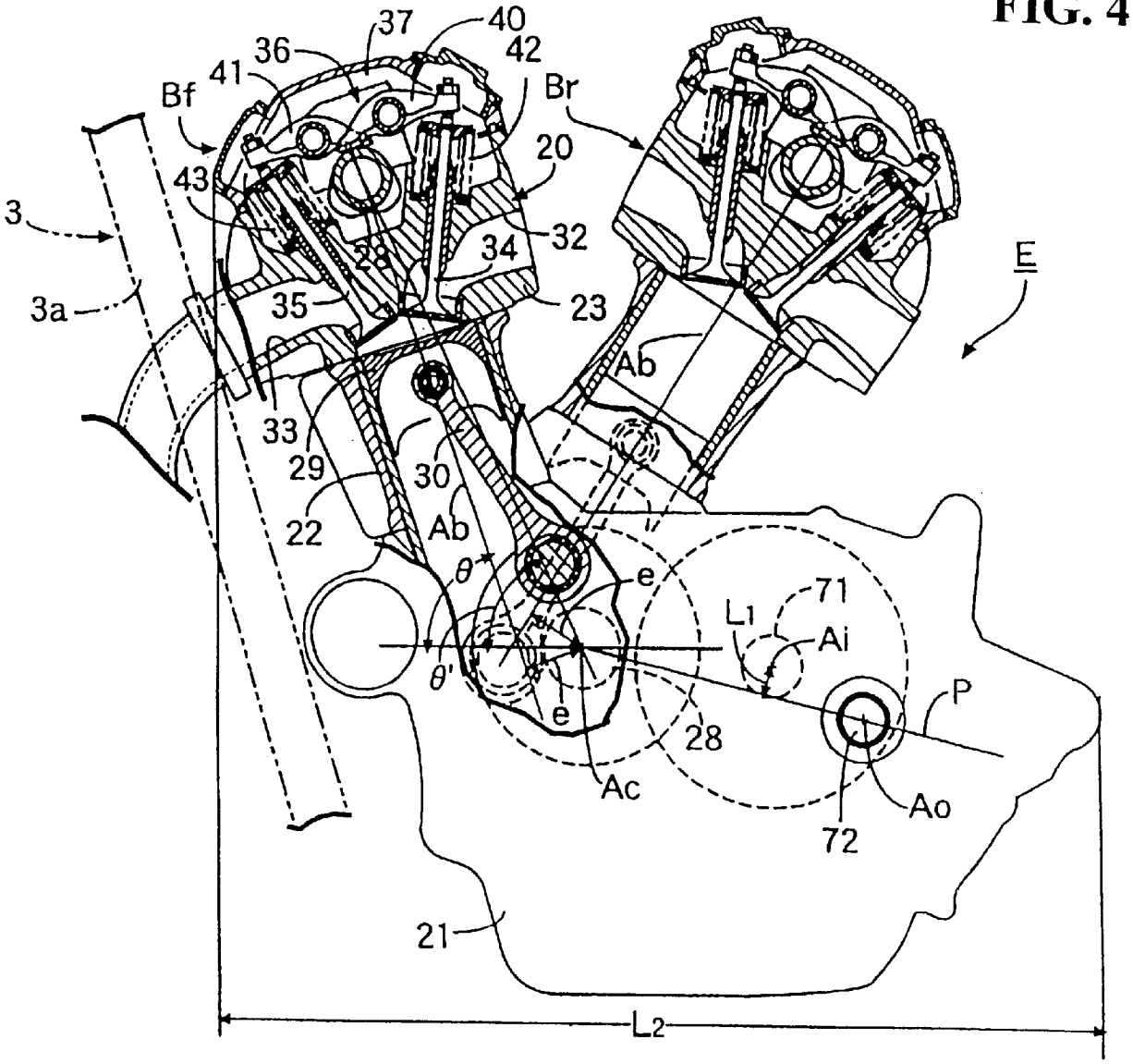
FIG. 4 is a side elevational view, partly in vertical cross section, of an engine according to a second embodiment of the present invention.

Embodiments of the present invention will now be described below with reference to the accompanying drawings. FIG. 1 is a side elevational view of a motorcycle, which incorporates an engine according to a first embodiment of the present invention. FIG. 2 is a side elevational view, partly in vertical cross section, of the engine according to the first embodiment. FIG. 3 is a cross-sectional view taken along line 3—3 of FIG. 2. FIG. 4 is a side elevational view, partly in vertical cross section, of an engine according to a second embodiment of the present invention.

It should be noted that the terms "front", "rear", "longitudinal", "left", "right", and "transverse" used in the description refer to directions with respect to a motorcycle M to which the motorcycle of the present invention is applied.

A first embodiment of the present invention as shown in FIGS. 1 and 2 will now be described below. In FIG. 1, a motorcycle M includes a vehicle frame F including a head pipe 1, a main tube 2 and a down tube 3. The main tube 2 is welded to an upper portion of the head pipe 1 and extends rearwardly and downwardly at a low gradient. The down tube 3 is welded to a lower portion of the head pipe 1. The down tube 3 includes a downward portion 3*a* extending downwardly from the head pipe 1, and a horizontal portion 3*b* bent rearwardly from the lower end of the downward portion 3*a*. A central tube 4 extending downwardly from an intermediate portion of the main tube 2 is connected to the rear end of the horizontal portion 3*b*. A stay 5 is connected between the main tube 2 and the down tube 3 in the vicinity of the head pipe 1. An engine E supported by the down tube 3 and the stay 5 is disposed in a space which is surrounded by the main tube 2, the down tube 3, the stay 5, and the central tube 4.

A front fork 7, on which a front wheel 6*f* is rotatably supported, is pivotally supported on the head pipe 1. A rear fork 8, on which a rear wheel 6*r* is supported, is pivotally supported on the rear end of the down tube 3 through a pivot shaft 9. A rear shock absorber or cushion 10 is connected between the rear fork 8 and the main tube 2. A fuel tank 11 and a saddle 12 are disposed on the main tube 2.

As shown in FIGS. 2 and 3, the engine E has an engine body 20 including a crankcase 21, a cylinder block 22 and a cylinder head 23. The cylinder block 22 is coupled to an upper portion of the front end of the crankcase 21 and projects upwardly and forwardly therefrom. The cylinder head 23 is joined to the upper end of the cylinder block 22.

A crankshaft 28 is housed in the crankcase 21. The crankshaft 28 is supported on the left and right side walls of the crankcase 21 by bearings 27, 27'. A piston 29 is slidable in a single cylinder bore 22*a* in the cylinder block 22. The piston 29 is connected to the crankshaft 28 by a connecting rod 30.

The cylinder head 23 has a combustion chamber 31, which is faced by the top surface of the piston 29, an intake port 32, and an exhaust port 33. The intake port 32 communicates with the combustion chamber 31 and opens at a rear surface of the cylinder head 23. The exhaust port 33 communicates with the combustion chamber 31 and opens at a front surface of the cylinder head 23. An intake valve 34 and an exhaust valve 35 for opening and closing the intake port 32 and the exhaust port 33, respectively, are mounted in the cylinder head 23. The intake valve 34 and the exhaust valve 35 are operated by a valve operating mechanism 36, which is disposed in a valve operating chamber 37 in the cylinder head 23.

The valve operating mechanism 36 includes a camshaft 38 rotatably supported on the cylinder head 23 by a pair of left and right bearings 39, 39'. The camshaft 38 is parallel to the crankshaft 28 in a position intermediate between the intake and exhaust valves 34, 35. An intake rocker arm 40 is pivotally supported on the cylinder head 23 and operatively interconnects the camshaft 38 and the intake valve 34. An exhaust rocker arm 41 is pivotally supported on the cylinder head 23 and operatively interconnects the camshaft 38 and the exhaust valve 35. Valve springs 42, 43 are provided for normally biasing the intake and exhaust valves 34, 35, respectively, in a valve closing direction.

The camshaft 38 is operatively coupled to the crankshaft 28 by a timing transmission device 51. The timing transmission device 51 includes a drive sprocket 52 fixed to the crankshaft 28. The drive sprocket 52 is disposed outwardly of and adjacent to the left bearing 27, which supports the crankshaft 28. A driven sprocket 53 is fixed to an end of the camshaft 38. An endless timing chain 54 is trained around the sprockets 52, 53. The timing transmission device 51 is capable of transmitting rotation of the crankshaft 28 to the camshaft 38 at a speed reduction ratio of 1/2. The timing chain 54 is disposed in a timing chain passage 55 that is defined in a side wall of the cylinder block 22.

A carburetor 13 (see FIG. 1) is connected to the intake port 32. The carburetor 13 is connected to the rear surface of the cylinder head 23. An exhaust pipe 14 (see also FIG. 1) is connected to the exhaust port 33. The exhaust pipe 14 is connected to the front surface of the cylinder head 23. A muffler 15 is connected to the rear end of the exhaust pipe 14.

The cylinder block 22 is disposed such that the cylinder bore 22*a* has an axis Ab offset forwardly a distance e with respect to an axis Ac of the crankshaft 28. The front end of the cylinder head 23 is positioned as closely to the downward portion 3*a* of the down tube 3 as possible, in the same manner as the conventional engine. Accordingly, the axis Ab of the cylinder block 22 rises from the horizontal plane through a relatively sharp angle θ. Preferably, the cylinder block 22 is arranged to extend parallel to the downward portion 3*a* of the down tube 3.

A breather chamber 57 is defined in a portion of the crankcase 21 close to the rear surface of the cylinder block 22. The breather chamber 57 has an inlet 57*a* communicating with the interior of the crankcase 21 and an outlet 57*b* communicating with an intake system including the carburetor 13 through a breather pipe 59. The interior of the breather chamber 57 is constructed as a labyrinth between the inlet 57*a* and the outlet 57*b* for separating lubricating oil from blow-by gas produced in the crankcase 21 while the blow-by gas is passing through the breather chamber 57.

A generator 60 has a rotor 61 keyed to one end of the crankshaft 28. The rotor 61 is connected to a starter gear 62, which is rotatably supported on the crankshaft 28 by a one-way clutch 63. The one-way clutch 63 transmits rotational forces from the starter gear 62 to the rotor 61 in one direction only. The starter gear 62 is rotated through a speed reduction gear train by a starter motor 65, which is mounted on a front portion of the crankcase 21 below the cylinder block 22.

The crankcase 21 accommodates a transmission 70 having an input shaft 71 and an output shaft 72, which extend parallel to the crankshaft 28. The input and output shafts 71, 72 are supported on the opposite side walls of the crankcase 21 by respective pairs of bearings 73, 73' and 74, 74'. Transmission gear trains $\mathbf{75}_1$ through $\mathbf{75}_n$ are interposed between the input and output shafts 71, 72. Power generated by the crankshaft 28 is transmitted through a centrifugal clutch 76, a primary speed reduction gear train 77, and a transmission clutch 78 to the input shaft 71. The power is then transmitted from the input shaft 71 through a selected transmission gear train to the output shaft 72, from which the power is transmitted through a chain transmitting device 79 (see FIG. 1) disposed outside of the crankcase 21 to the rear wheel 6*r*, thus rotating the rear wheel 6*r*.

In the transmission 70, the input shaft 71 is disposed such that an axis Ai is offset upwardly a distance s with respect to a plane P which includes the axes Ac, Ao of the crankshaft 28 and the output shaft 72 at a position intermediate between the crankshaft 28 and the output shaft 72.

Operation of the above embodiment will be described below.

FIG. 2 shows the outline of a conventional engine E' as indicated by the chain lines. A comparison between the outlines of the engine E according to the present invention and the conventional engine E' shows that the cylinder block 22 is arranged such that the angle θ, through which the axis Ab of the cylinder block 22 rises from the horizontal plane, is greater than the conventional angle θ' and the axis Ab of the cylinder block 22 passes forwardly of the axis Ac of the crankshaft 28, if the front end of the cylinder head 23 is positioned as closely to the downward portion 3*a* of the down tube 3 as possible. Therefore, a free upper area of the crankcase 21, which is not obstructed by the cylinder block 22, is widened without changing the position of the front end of the engine E. Therefore, the upward offset s of the input shaft 71 with respect to the horizontal plane P can be increased when compared to the conventional offset s' without being obstructed by the cylinder block 22. Accordingly, the interaxial distance $L_1$ between the crankshaft 28 and the output shaft 72 is effectively made much smaller than the conventional interaxial distance $L_1'$. As a result, the size of the crankcase 21 in the longitudinal direction of the motorcycle is decreased, thus greatly reducing the overall length $L_2$ of the engine E in the longitudinal direction of the motorcycle. Accordingly, the overall length $L_2$ can be made smaller than the conventional overall length $L_2'$ for thereby effectively making the engine E compact. Particularly, if the cylinder block 22 is parallel to the downward portion 3*a* of the down tube 3 of the vehicle frame F, the dead space between the downward portion 3*a* and the cylinder head 23 is minimized for thereby reducing the wheelbase of the motorcycle M.

The offset of the axis Ab of the cylinder bore 22*a* with respect to the axis Ac of the crankshaft 28 causes a reduction in the angle of inclination of the connecting rod 30 under a maximum pressure in the expansion stroke of the engine E. As a result, a side thrust, which the piston 29 receives from the inner surface of the cylinder bore 22*a*, is reduced. This reduces the frictional resistance to the sliding motion of the piston 29, which contributes to lower fuel consumption.

Since the breather chamber 57 is defined in the portion of the crankcase 21 close to the rear surface of the cylinder block 22, the dead space between the cylinder block 22 and the input shaft 71 in the crankcase 21 is effectively utilized to form the breather chamber 57. Accordingly, the engine E can be made more compact.

A second embodiment of the present invention will now be described below with reference to FIG. 4.

The present invention is applied to a V-shaped engine E having a front bank Bf and a rear bank Br. The front bank Bf corresponds to the cylinder block 22 and the cylinder head 23 according to the first embodiment. The rear bank Br is arranged such that the axis Ab of the cylinder block 22 is offset forwardly a distance e with respect to the axis Ac of the crankshaft 28 in order to avoid interference with the transmission 70. In the illustrated embodiment, the forward offset of the cylinder block axis Ab from the crankshaft axis Ac of the front bank Bf and the forward offset of the cylinder block axis Ab from the crankshaft axis Ac of the rear bank Br are set to equal distances e. However, these offsets may be set to different distances.

Other structural details of the second embodiment are identical to those of the first embodiment. Therefore, the parts of the second embodiment which correspond to the parts of the first embodiment are denoted by identical reference characters, and will not be described in detail below.

The present invention is not limited to the above embodiments, but may be modified in design without departing from the scope thereof.

According to the first feature of the present invention, as described above, an engine for a motor vehicle has a crankcase, a cylinder block, and a cylinder head. The cylinder block extends upwardly and forwardly of the motor vehicle from an upper portion of the front end of the crankcase. The cylinder head is joined to the upper end of the cylinder block. The crankcase houses and supports a crankshaft, a transmission input shaft, and a transmission output shaft which are arranged to have their axes oriented transversely of the motor vehicle. The transmission input shaft is offset upwardly with respect to a plane, which includes the axes of the crankshaft and the transmission output shaft. The cylinder block is disposed to have an axis passing forwardly of the axis of the crankshaft. With the cylinder block being disposed to have an axis passing forwardly of the axis of the crankshaft, the angle through which the axis of the cylinder block rises from the horizontal plane is increased. This widens a free upper area of the crankcase, which is not obstructed by the cylinder block, without changing the position of the front end of the engine. Therefore, the upward offset of the input shaft with respect to the horizontal plane can be sufficiently increased without being obstructed by the cylinder block. This effectively making the engine compact in the longitudinal direction of the motor vehicle. The offset of the axis of the cylinder block with respect to the axis of the crankshaft causes a reduction in the angle of inclination of the connecting rod under a maximum pressure in the expansion stroke of the engine. A side thrust, which the piston receives from the inner surface of the cylinder bore is reduced, reduces the frictional resistance to the sliding motion of the piston. This contributes to lower fuel consumption.

According to the second feature of the present invention, in addition to the first feature, the cylinder block is disposed substantially parallel to a downward portion of a down tube of the vehicle frame. Consequently, the dead space between the down tube and the cylinder head is minimized to reduce the wheelbase of the motor vehicle.

According to the third feature of the present invention, in addition to the first and second features, a breather chamber communicating with the interior of the crankcase is mounted on a portion of the crankcase near a rear surface of the cylinder block. Consequently, the dead space present between the cylinder block and the input shaft in the crankcase is effectively utilized to form the breather chamber, further making the engine compact.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine for a motor vehicle, comprising:

a crankcase;

a cylinder block, said cylinder block being positionable to extend upwardly and forwardly of the motor vehicle from an upper portion of a front end of said crankcase; and a cylinder head, said cylinder head being joined to an upper end of said cylinder block, wherein said crankcase houses and supports a crankshaft, a transmission input shaft, and a transmission output shaft arrangeable to have respective axes thereof oriented transversely of the motor vehicle;

said transmission input shaft is offset upwardly with respect to a plane including the axes of said crankshaft and said transmission output shaft, and said cylinder block is disposed to have an axis thereof passing forwardly of the axis of said crankshaft.

2. The engine for a motor vehicle according to claim 1, wherein said cylinder block is disposable substantially parallel to a downward portion of a down tube of a vehicle frame of the motor vehicle.

3. The engine for a motor vehicle according to claim 1, wherein a breather chamber communicates with an interior of said crankcase, said breather chamber being mounted on a portion of said crankcase near a rear surface of said cylinder block.

4. The engine for a motor vehicle according to claim 2, wherein a breather chamber communicates with an interior of said crankcase, said breather chamber being mounted on a portion of said crankcase near a rear surface of said cylinder block.

5. The engine for a motor vehicle according to claim 1, wherein said engine has a single bank with a single cylinder formed therein, and a single piston is reciprocable within said single cylinder.

6. The engine for a motor vehicle according to claim 2, wherein said engine has a single bank with a single cylinder formed therein, and a single piston is reciprocable within said single cylinder.

7. The engine for a motor vehicle according to claim 1, wherein said engine has a pair of banks, each of said pair of banks having a single cylinder formed therein and a single piston reciprocable within said single cylinder.

8. The engine for a motor vehicle according to claim 7, wherein said cylinder block includes a front cylinder block and a rear cylinder block, one of said pair of banks is a front bank formed by said front cylinder block extending upwardly and forwardly from said crankcase, the other of said pair of banks is a rear bank formed by said rear cylinder block extending upwardly and rearwardly from said crankcase, and each of said front cylinder block and rear cylinder block is disposed to have an axis thereof passing forwardly of the axis of said crankshaft.

9. The engine for a motor vehicle according to claim 8, wherein a distance between the axis of said front cylinder block and said crankshaft and a distance between the axis of said rear cylinder block and said crankshaft are equal.

10. The engine for a motor vehicle according to claim 1, wherein said cylinder block is disposable substantially parallel to a downward portion of a down tube of a vehicle frame of the motor vehicle, and a starter motor is mounted on a front portion of said crankcase below said cylinder block.

11. A motor vehicle, comprising:

a vehicle frame;

at least a pair of wheels supported for rotation on said vehicle frame; and an engine, said engine comprising:

a crankcase;

a cylinder block, said cylinder block being positioned to extend upwardly and forwardly of the motor vehicle from an upper portion of a front end of said crankcase; and a cylinder head, said cylinder head being joined to an upper end of said cylinder block, wherein said crankcase houses and supports a crankshaft, a transmission input shaft, and a transmission output shaft arranged to have respective axes thereof oriented transversely of the motor vehicle, said transmission input shaft is offset upwardly with respect to a plane including the axes of said crankshaft and said transmission output shaft, and said cylinder block is disposed to have an axis thereof passing forwardly of the axis of said crankshaft.

12. The motor vehicle according to claim 11, wherein said cylinder block is disposable substantially parallel to a downward portion of a down tube of said vehicle frame.

13. The motor vehicle according to claim 12, wherein a breather chamber communicates with an interior of said crankcase, said breather chamber being mounted on a portion of said crankcase near a rear surface of said cylinder block.

14. The motor vehicle according to claim 12, wherein said engine has a single bank with a single cylinder formed therein, and a single piston is reciprocable within said single cylinder.

15. The motor vehicle according to claim 11, wherein a breather chamber communicates with an interior of said crankcase, said breather chamber being mounted on a portion of said crankcase near a rear surface of said cylinder block.

16. The motor vehicle according to claim 11, wherein said engine has a single bank with a single cylinder formed therein, and a single piston is reciprocable within said single cylinder.

17. The motor vehicle according to claim 11, wherein said engine has a pair of banks, each of said pair of banks having a single cylinder formed therein and a single piston reciprocable within said single cylinder.

18. The motor vehicle according to claim 17, wherein said cylinder block includes a front cylinder block and a rear cylinder block, one of said pair of banks is a front bank formed by said front cylinder block extending upwardly and forwardly from said crankcase, the other of said pair of banks is a rear bank formed by said rear cylinder block extending upwardly and rearwardly from said crankcase, and each of said front cylinder block and rear cylinder block is disposed to have an axis thereof passing forwardly of the axis of said crankshaft.

19. The motor vehicle according to claim 18, wherein a distance between the axis of said front cylinder block and said crankshaft and a distance between the axis of said rear cylinder block and said crankshaft are equal.

20. The motor vehicle according to claim 11, wherein said cylinder block is disposed substantially parallel to a downward portion of a down tube of said vehicle frame of said motor vehicle, and a starter motor is mounted on a front portion of said crankcase below said cylinder block.

* * * * *